US005544463A

United States Patent [19]

Bergin

[11] Patent Number: 5,544,463

[45] Date of Patent: Aug. 13, 1996

[54] PREFINISHED CORNER BEAD

[76] Inventor: Blaine R. Bergin, P.O. Box 992, Emmett, Id. 83617

[21] Appl. No.: 297,974

[22] Filed: Aug. 30, 1994

[51] Int. Cl.[6] ..... E04B 1/00

[52] U.S. Cl. ..... 52/254; 52/288.1; 52/716.1

[58] Field of Search ..... 52/254, 255, 257, 52/258, 259, 287.1, 288.1, 716.1

[56] References Cited

U.S. PATENT DOCUMENTS

| | | | |
|---|---|---|---|
| 3,047,112 | 7/1962 | Tvorik et al. | 52/254 X |
| 3,712,003 | 1/1973 | Hallock | 52/254 |
| 4,545,162 | 10/1985 | Attaway | 52/255 |
| 4,706,426 | 11/1987 | Rumsey | 52/232 |
| 4,852,318 | 8/1989 | Anderson | 52/388 |
| 5,086,598 | 2/1992 | Weldy | 52/288 |

*Primary Examiner*—Creighton Smith
*Attorney, Agent, or Firm*—Craig M. Korfanta

[57] ABSTRACT

A prefinished corner bead for application to finished interior walls, which may be utilized on either inside corners or outside corners, and which may take on any number of different configurations, any of which would provide a recessed face which is configured to accept a variety of decorative or ornamental finish trims. The prefinished corner bead is manufactured in such a manner that an expansion joint is provided which helps eliminate cracking and displacement of finished wall surfaces due to the expansion and contraction of structural surfaces.

13 Claims, 9 Drawing Sheets

PREFINISHED CORNER BEAD

BACKGROUND OF THE INVENTION

1. Technical Field

The present invention relates generally to building materials, and more particularly to a prefinished corner bead which is adapted to serve both protective purposes and purposes of providing an attractive or decorative finish surface to both inside and outside corners of finished interior walls.

2. Background

It is common in the building trade, when finishing interior walls, to utilize a corner bead molding, particularly on outside corners, to serve the purpose of providing a durable corner bead, as well as a surface which can accept drywall compound for later finishing and painting. Corner moldings may likewise be applied to finish inside corners. Also, it is common when employing wood finishes or paneling to the surface of interior walls and the casings around interior openings, to provide some type of a corner molding to present a finished appearance and protection for the exposed corners. Once again, these types of moldings are typically applied to outside corners of interior walls where the corner is exposed to abuse, but may also be applied to inside corners for finish and protection purposes.

The prior art includes the well-known sheet metal bead which is typically employed in finishing drywall or sheetrock interior surfaces.

Additionally, the prior art describes a variety of corner moldings, including Anderson, U.S. Pat. No. 4,852,318, bullnose corner piece; Weldy, U.S. Pat. No. 5,086,598, wallboard joint reinforcing system; Rumsey, U.S. Pat. No. 4,706,426, fire-rated flush-mounted corner guard; and Attaway, U.S. Pat. No. 4,545,162, moldings.

The above-referenced patents describe a variety of items for use in a variety of circumstances. Anderson describes essentially a cap or bullnose corner piece which fits over the wall covering at an exterior corner, extending laterally along the surface of the finished wall. Anderson describes a piece which is fit up against the ends of the wall covering, as opposed to laying over the wall covering. Additionally, Anderson describes a system which is only applied to outside corners, as opposed to both interior and outside corners.

Weldy describes a wall edging system for strength reinforcing and strengthening corners and intersections of wall sections. Weldy does not provide a finished appearance and is applied directly over the wall surfacing and is intended by its description more for protection than finish.

Rumsey describes an elaborate system for protecting corners which by its nature is a fairly heavy and complicated construction in order to achieve its fire rated status. Rumsey calls out an insulating layer, a cap which overlays the insulating material, a mounting portion or mounting means which holds the cover in position by action of spring clips.

Attaway describes a rigid molding formed by extrusion which allows for a reveal which is to be exposed as a finished surface.

One objective of the present invention is to allow the builder to select from any number of finish trim veneers which are secured within the veneer recess by an adhesive. The use of a veneer provides advantages in terms of economics, choice or selection of finishes and utilization of resources. The cost of a veneer is far less than a solid finish member which would reveal the same finished surface. Additionally the availability of some fine hardwoods is diminishing, hence the use of a veneer serves to conserve these resources.

In addition, nowhere in the prior art is there described a corner molding which serves both to protect the corner from damage due to impact and which will serve an ornamental function by providing a prefinished surface, as well as providing the capacity to expand and contract with the inherent movement of structural wall systems. The present invention satisfies each of these conditions or objectives by providing a light gauge bead which is preformed for either an interior or exterior corner, the corner bead having a recessed face which is configured to accept a variety of decorative or ornamental finish trims, and the corner bead being formed in such a manner that an expansion joint is provided which may help eliminate cracking and displacement in finished wall surfaces due to the expansion and contraction of structural surfaces. Finally, the described system may be applied to both inside and outside corners.

DISCLOSURE OF INVENTION

Accordingly, my invention is a prefinished corner bead for application to finished interior walls, which may be utilized on either inside corners or outside corners, and which may take on any number of different configurations, any of which would provide a recessed face which is configured to accept a variety of decorative or ornamental finish trims. The prefinished corner bead is manufactured or fabricated in such a manner that an expansion joint is provided which helps eliminate cracking and displacement of finished wall surfaces due to the expansion and contraction of structural surfaces. The prefinished corner bead may be formed by conventional manufacturing processes such as extruding, stamping or pressing of a light gauge sheet metal or plastic strip to a desired form.

Prefinished corner bead may be used for wall to wall corner joints or for wall to ceiling corner joints. In addition, this system provides for an intersection fitting for use at intersections where two walls and the ceiling meet. The prefinished corner bead is compatible for use with any combination of conventional and construction techniques, including drywall, plaster and lath and wood finishes.

BEST MODE FOR CARRYING OUT INVENTION

Figure 1:
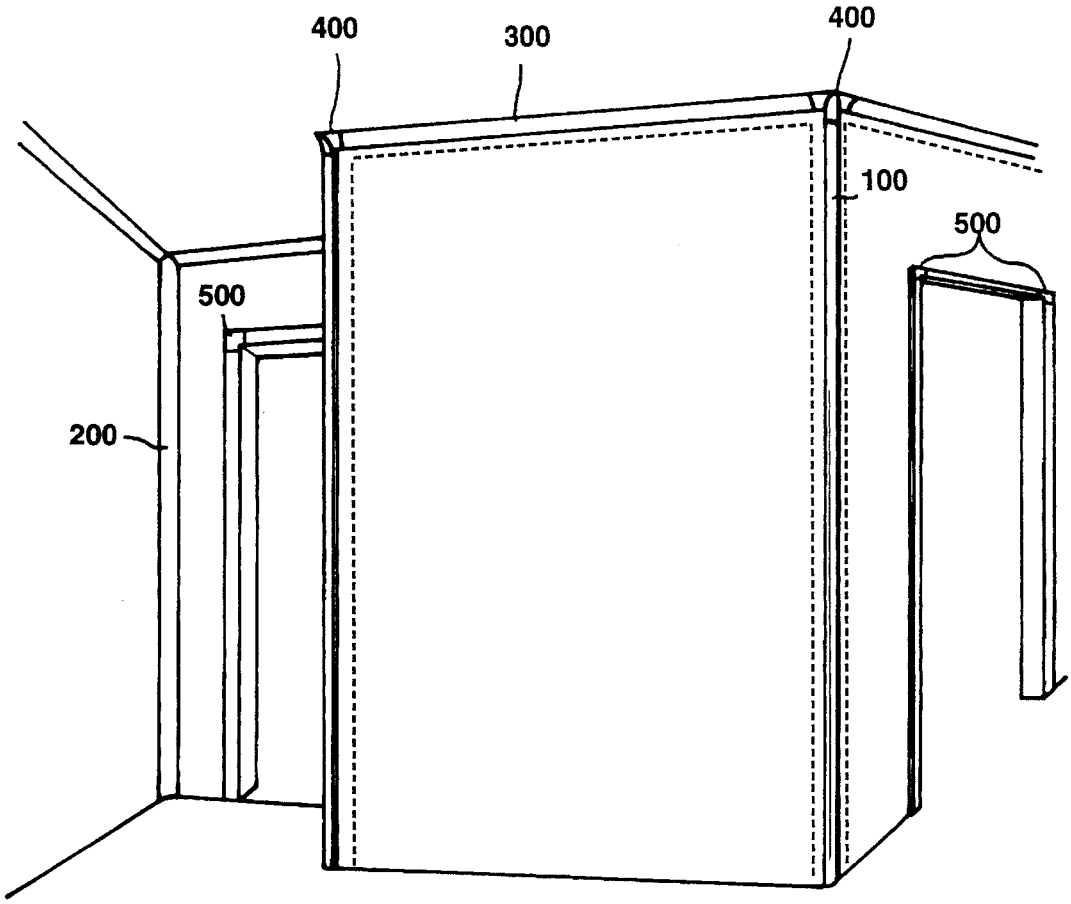
FIG. 1 is an isometric view showing prefinished corner beads applied to two outside wall-to-wall corners, one inside wall-to-wall corner, inside wall-to-ceiling corners and prefinished corner bead intersection fittings.

FIG. 1 is an isometric view depicting several wall sections, including outside and inside corners. FIG. 1 demonstrates the application of the prefinished corner bead 100, for an outside corner wall-to-wall application.

Similarly, a prefinished wall bead 200 is shown on an inside corner wall-to-wall application. Prefinished corner bead 300 is shown applied to an inside corner wall-to-ceiling application. Prefinished corner bead intersection fitting 400 is shown applied at the juncture of two outside walls and a ceiling, while prefinished corner bead intersection fitting 500 is shown applied to the inside corner of an interior opening, such as a doorway.

Figure 2:
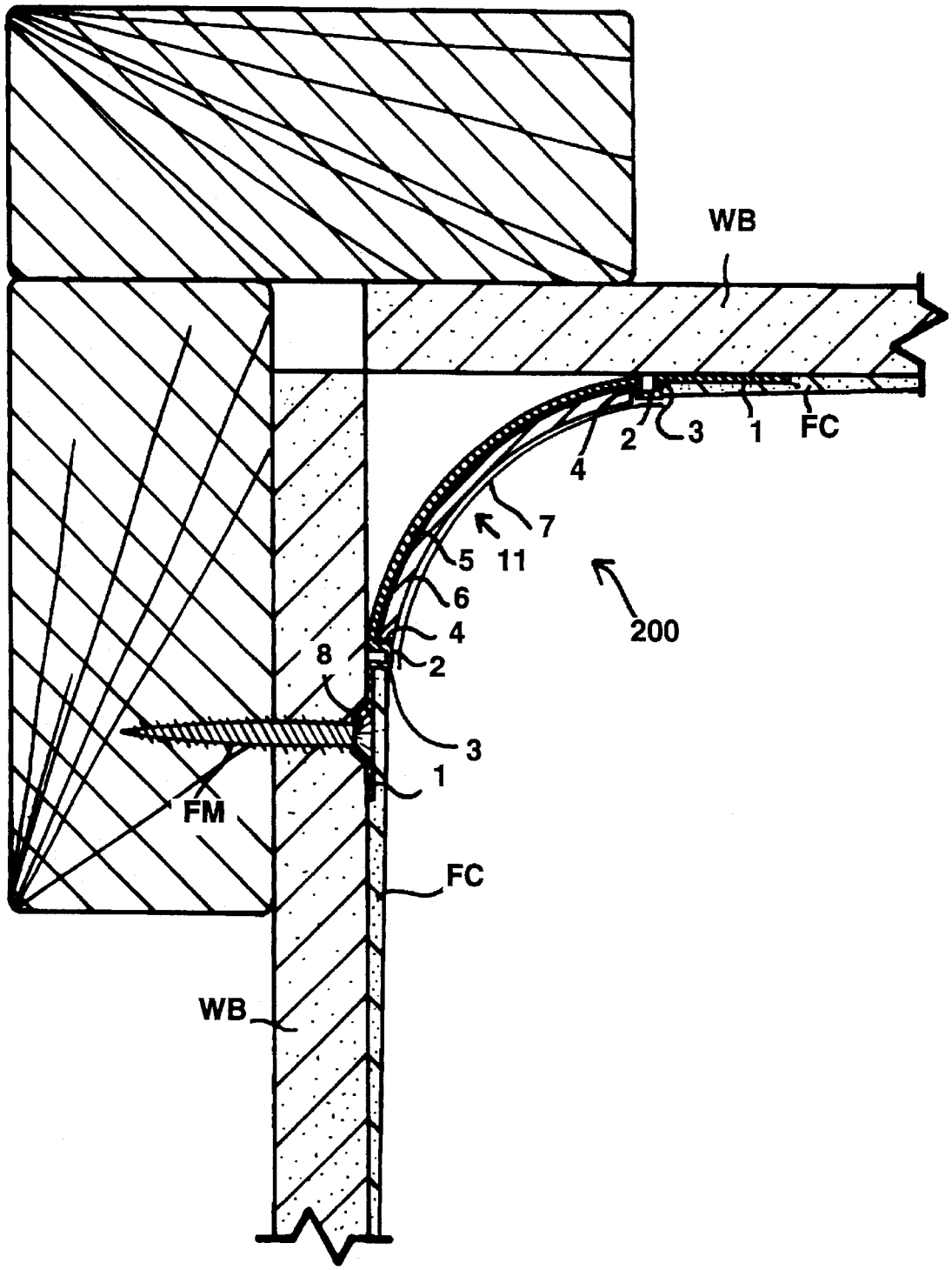
FIG. 2 is a horizontal cross-sectional view of an inside wall-to-wall prefinished corner bead compatible with standard drywall construction.

Referring to FIG. 2, a typical prefinished corner bead for application to an inside wall corner 200 is shown to advantage. Prefinished corner bead 200 may be formed by a conventional manufacturing process, such as by extruding, stamping or pressing a light gauge sheet metal or plastic strip to the desired form. Fastening flanges 1 extend laterally from the corner bead's center and longitudinal axis. Fastening flanges 1 may be configured to provide a plurality of holes 8 to both accommodate fastening means FM, and to facilitate adherence of finishing compound FC. Fastening means FM are used to secure the prefinished corner bead to the wall board WB.

Stop-bead/expansion joints 2 are formed also during the manufacturing process in such a manner that each stop-bead/expansion joint 2 has a generally U-shaped cross sectional configuration. Because of its generally U-shaped cross sectional configuration, each stop-bead/expansion joint 2 is configured such that in the cross section the stop-bead/expansion joint comprises in part two sidewalls, 3 and 4. One sidewall 3 extends contiguously from fastening flange 1 to stop-bead/expansion joint 2. The second sidewall 4 extends contiguously from stop-bead/expansion joint 2 to a recessed face 5. Recessed face 5 spans the corner where wallboard WB is to be finished.

As shown in FIG. 2, prefinished corner bead 200 spans an inside corner joint. The juncture of recessed face 5 and expansion joint 2 at sidewall 4 forms a recess 11 into which veneer 6 is placed. Veneer 6 may be held in place within recess 11 by any conventional adhesive. Veneer 6 or veneer 6 and stop-bead/expansion joint 2 are covered by a temporary installation of thin removable plastic film strip 7 during the construction phase to protect the finished surfaces during construction. In this preferred embodiment, plastic film 7 is applied electrostatically.

Veneer 6 may be formed of a variety of materials, including wood, foils, metals or plastics. Wood veneers could be natural or prestained and lacquered and/or sealed. Foil could be provided in a variety of colors including brass, bronze, chrome or copper in both polished or satin appearance. A plastic or enamel veneer could be provided in both stock and custom colors to match the decor of the building and particular decorating themes.

Finishing compound F is applied to the wallboard WB flush with the top surface of stop-bead/expansion joint 2, concealing fastening flange 1 and the head of fastening means FM. Thin removable plastic film strip 7 is removed upon completion of construction to expose veneer 6 and stop bead/expansion joints 2.

These features explained above are typical of all of the various embodiments of the prefinished corner bead.

The prefinished corner bead for application to an inside corner joint may be configured for application to any inside corner having an included angle from 0° to 180°.

Figure 3:
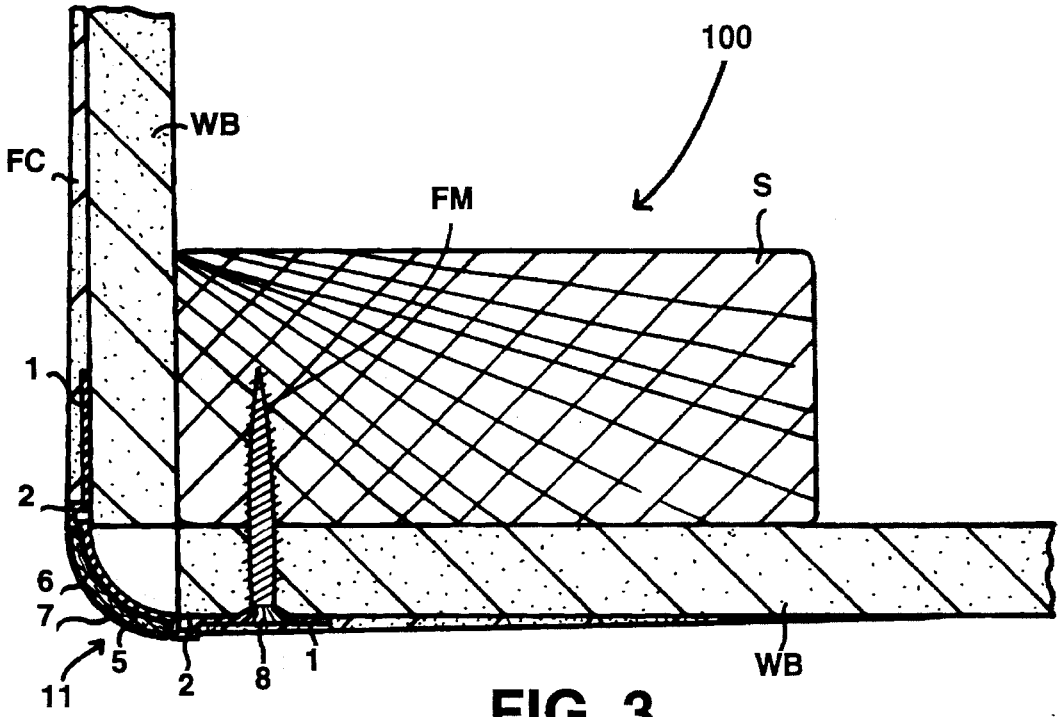
FIG. 3 is a horizontal cross-sectional view of an outside wall-to-wall prefinished corner bead compatible with standard drywall construction.

FIG. 3 shows to advantage a prefinished corner bead 100 adapted for application to an outside wall-to-wall corner. Veneer 6 is shaped to fit against recessed face 5 and within recess 11 which, in this case, is the outside corner formed at the juncture of wall boards WB.

The prefinished corner bead for application to an outside corner joint may be configured for application to any outside corner angle having an included angle from 180° to 360°.

Figure 4:
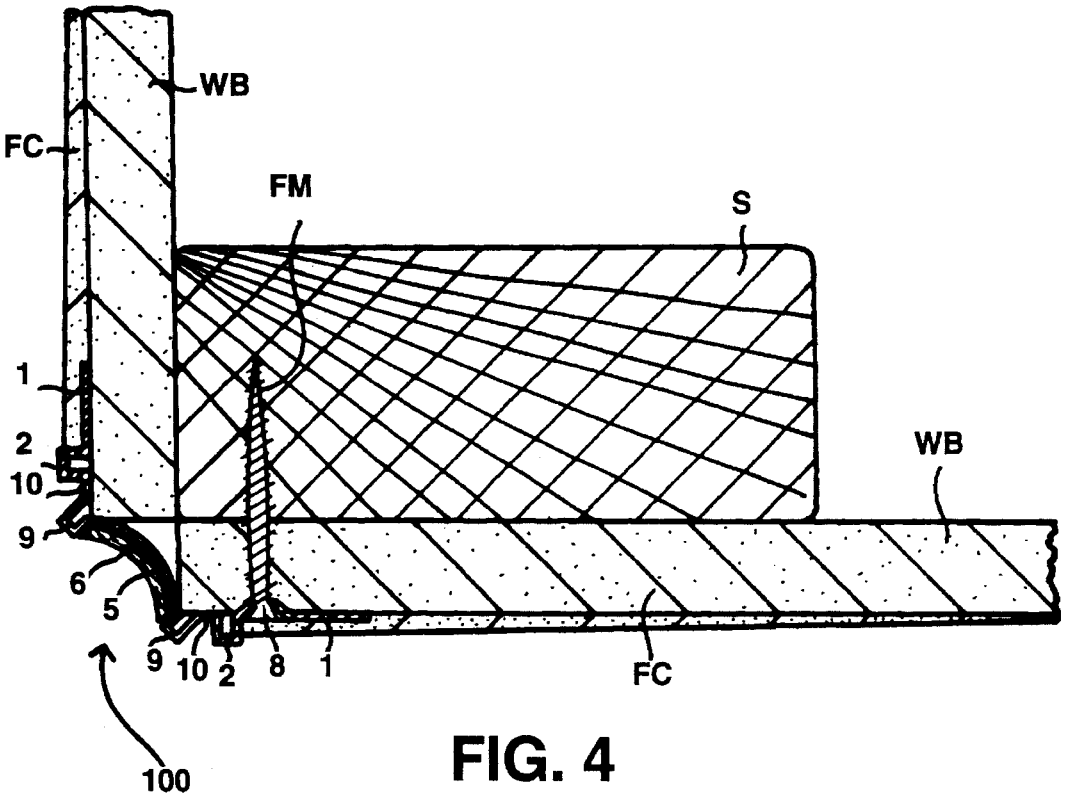
FIG. 4 is a horizontal cross-sectional view of an outside wall-to-wall prefinished corner bead compatible with standard drywall construction.

FIG. 4 shows to advantage a modification of the prefinished corner bead 100 which embodies a primary stop-bead/expansion joint 2 and a secondary expansion joint 9. Secondary expansion joint 9 and stop bead expansion joint 2 are joined by bridge 10. FIG. 4 also shows a modification of recessed face 5 which is adapted to accept a concave veneer 6 for finishing an outside corner wall.

Figure 5:
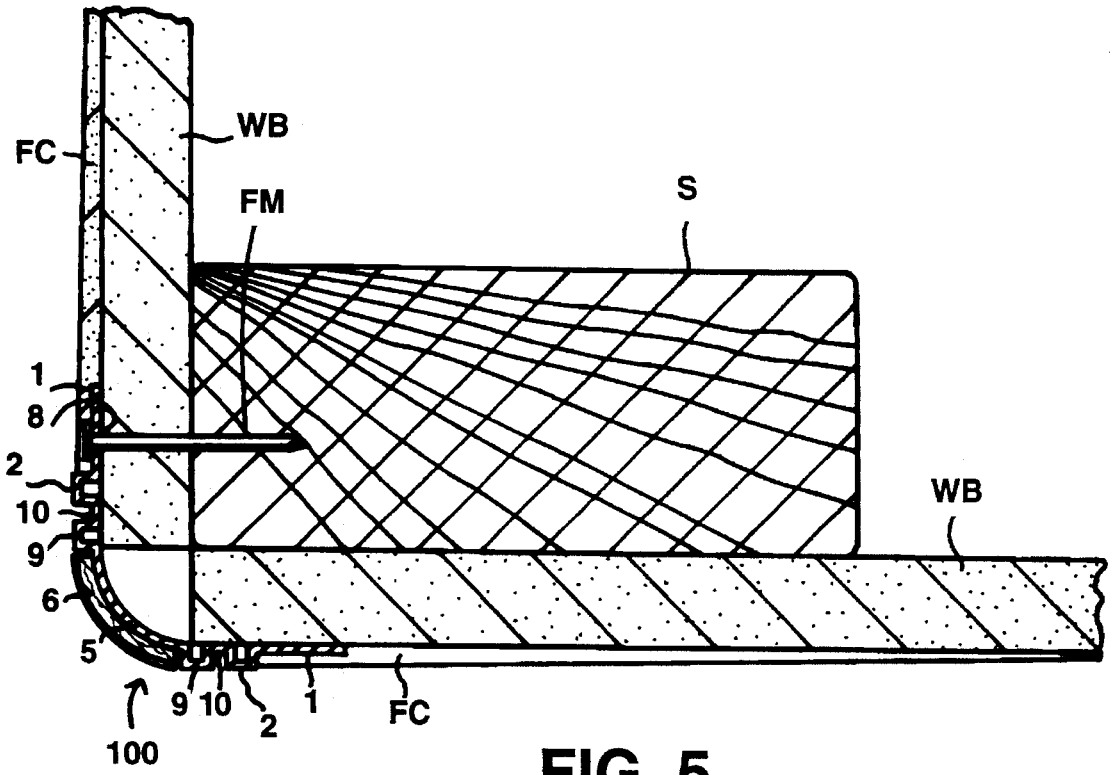
FIG. 5 is a horizontal cross-sectional view of an outside wall-to-wall prefinished corner bead compatible with standard drywall construction.

FIG. 5 shows to advantage a convex cross-sectional configuration for a prefinished corner bead 100 which employs the secondary expansion joint 9 and is further configured to accept a convex veneer 6 for finishing an outside corner.

Figure 6:
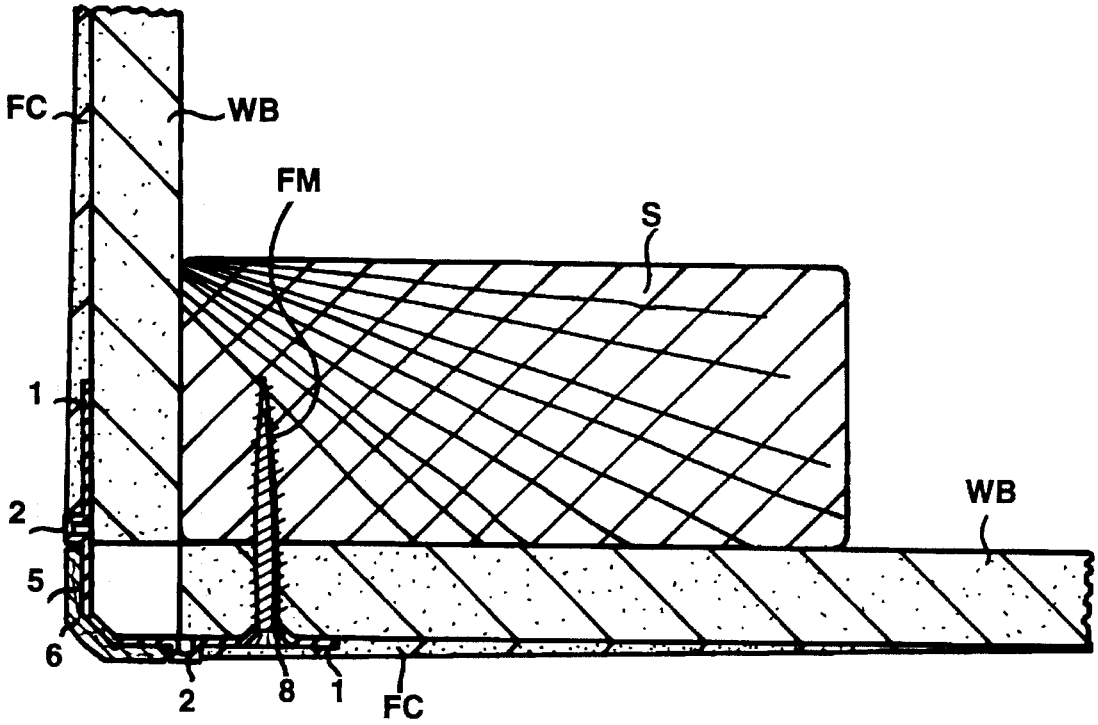
FIG. 6 is a horizontal cross-sectional view of an outside wall-to-wall prefinished corner bead compatible with standard drywall construction.

FIG. 6 shows yet another modification of the prefinished corner bead 100 which depicts a three-sided veneer 6.

Figure 7:
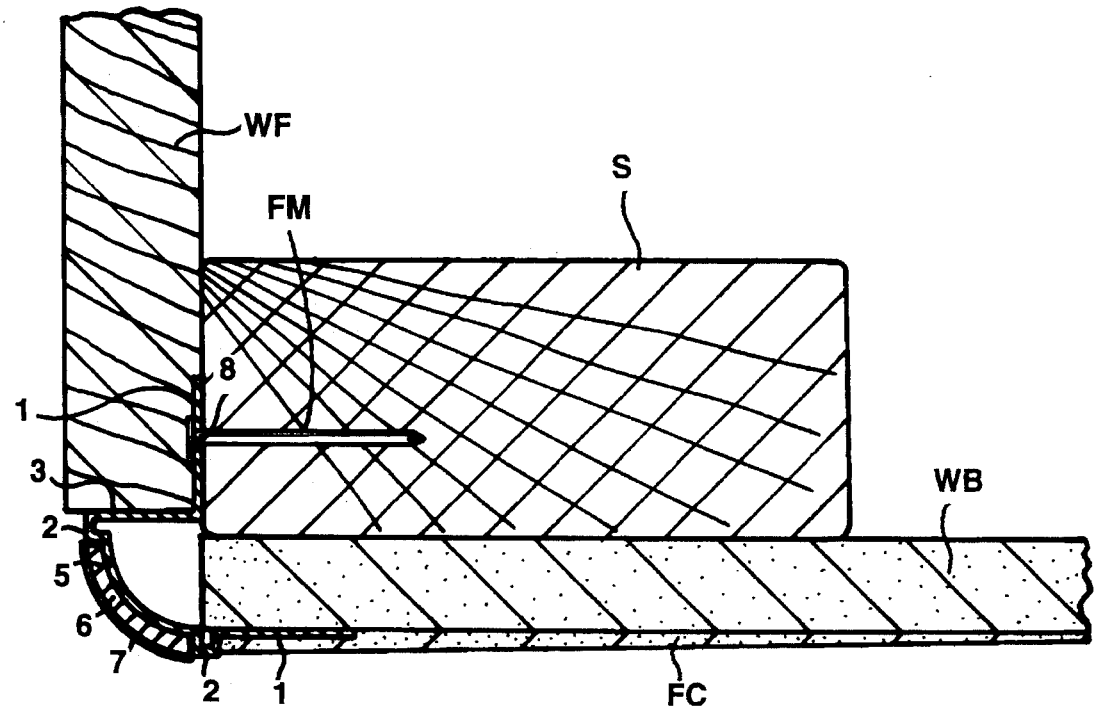
FIG. 7 is a horizontal cross-sectional view of an outside wall-to-wall prefinished corner bead showing one flange compatible with drywall construction and the other flange compatible with wood finish or casing material.

FIG. 7 shows to advantage a prefinished corner bead 100 which is adapted to accept wood finish WF on one side of the bead and conventional wallboard WB on the second side as wood typical of a door or window casing. In this particular embodiment, one sidewall 3 extends inward and laterally for attachment to fastening flange 1, such that fastening flange 1 may be secured directly to structure S. In this manner wood finish WF or other finished wall product overlays fastening flange 1.

Figure 8:
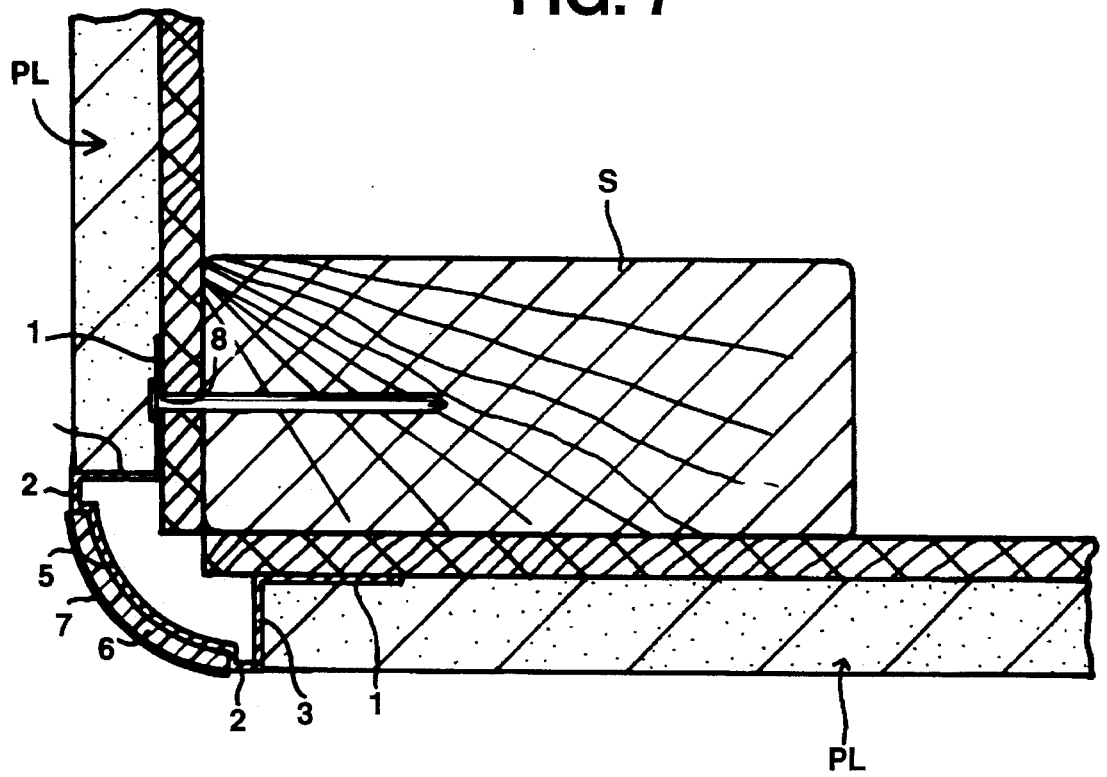
FIG. 8 is a horizontal cross-sectional view of an outside wall-to-wall prefinished corner bead compatible with plaster and lath construction.

FIG. 8 shows to advantage a prefinished corner bead 100 compatible with plaster and lath construction PL on both sides of the prefinished corner bead 100. In this particular embodiment, both sidewalls 3 extend inward and laterally for attachment to fastening flanges 1, such that fastening flanges 1 may be secured directly to structure S. In this manner paneling P or other finished wall product overlays both fastening flanges 1.

Figure 9:
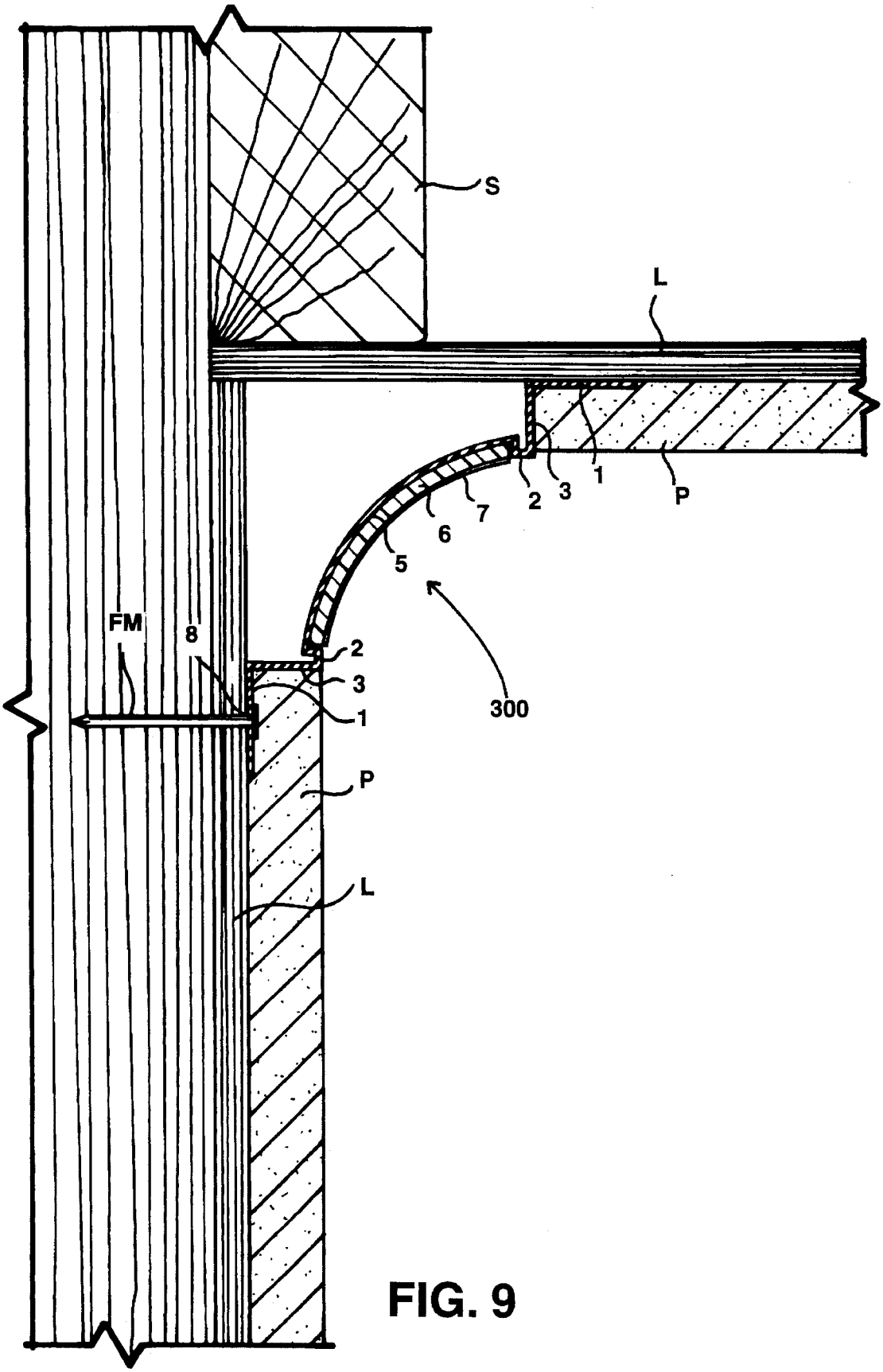
FIG. 9 is a horizontal cross-sectional view of an inside wall-to-ceiling prefinished corner bead compatible with plaster and lath construction.

FIG. 9 shows to advantage a prefinished corner bead 300 adapted to be utilized on an inside corner where a wall meets a ceiling and is compatible with plaster and lath construction PL. In this particular embodiment, both sidewalls 3 extend inward and laterally for attachment to fastening flanges 1, such that fastening flanges 1 may be secured directly to lath L. In this manner plaster P or other finished wall product overlays both fastening flanges 1.

Figure 10:
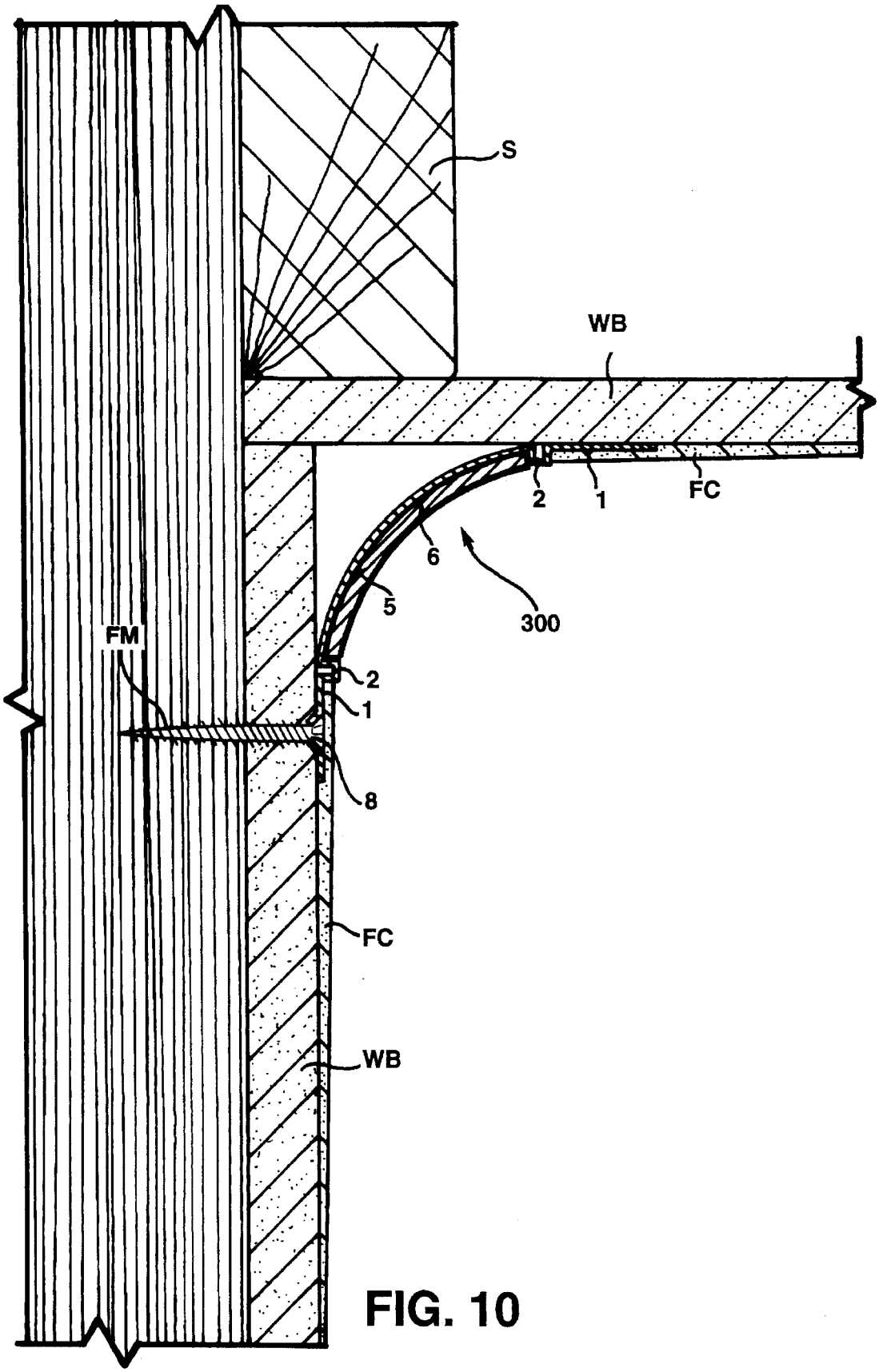
FIG. 10 is a horizontal cross-sectional view of an of an inside wall-to-ceiling prefinished corner bead compatible with drywall construction.

FIG. 10 shows to advantage yet another adaptation for utilizing the prefinished corner bead 300 in a wall-to-ceiling inside corner joint.

Figure 11:
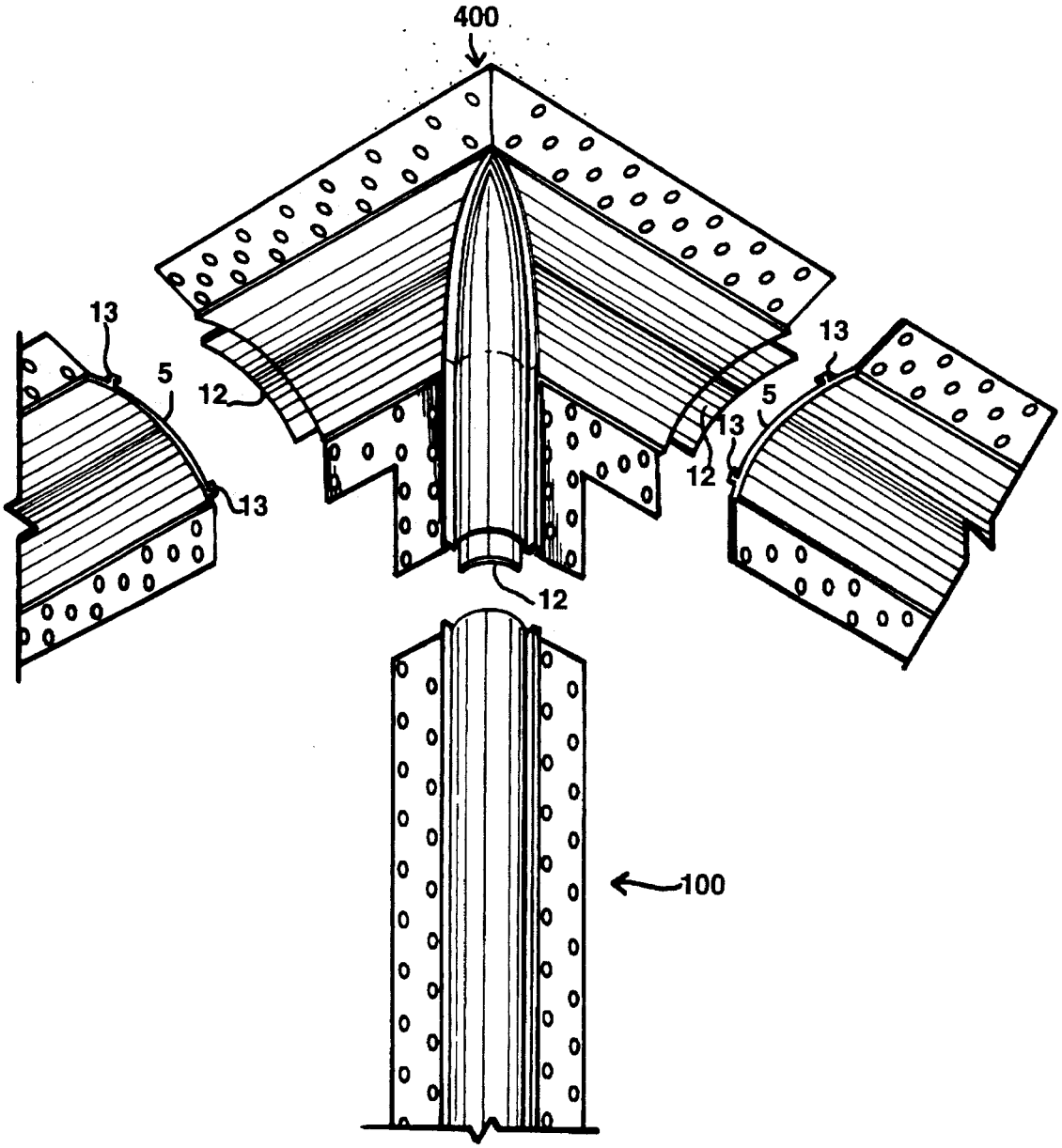
FIG. 11 is an exploded isometric view of a compound outside corner intersection fitting for the prefinished corner bead.

FIG. 11 shows to advantage a prefinished corner bead intersection fitting 400 for application at the juncture of an outside wall-to-wall corner and ceiling. Intersection fitting 400 consists of a central structure having three appendages extending in different directions. Each appendage is configured to mate with a corresponding corner bead. For example, the downward extending appendage is configured to mate with a bullnose corner bead 100. The distal end of the downward extending appendage is provided with a tongue 12 to facilitate the joint between intersection fitting 400 and prefinished corner bead 100. Similarly, both laterally extending appendages may be provided with tongues 12 to facilitate those joints. An optional feature of the invention has a pair of L-shaped appendages 13 extending from the back surface of recess face 5, in spaced apart relation, to form a receiving channel for tongue 12. This feature could also be used to facilitate joining two sections of prefinished corner bead at a butt joint using a separate tongue member 12.

Figure 12:
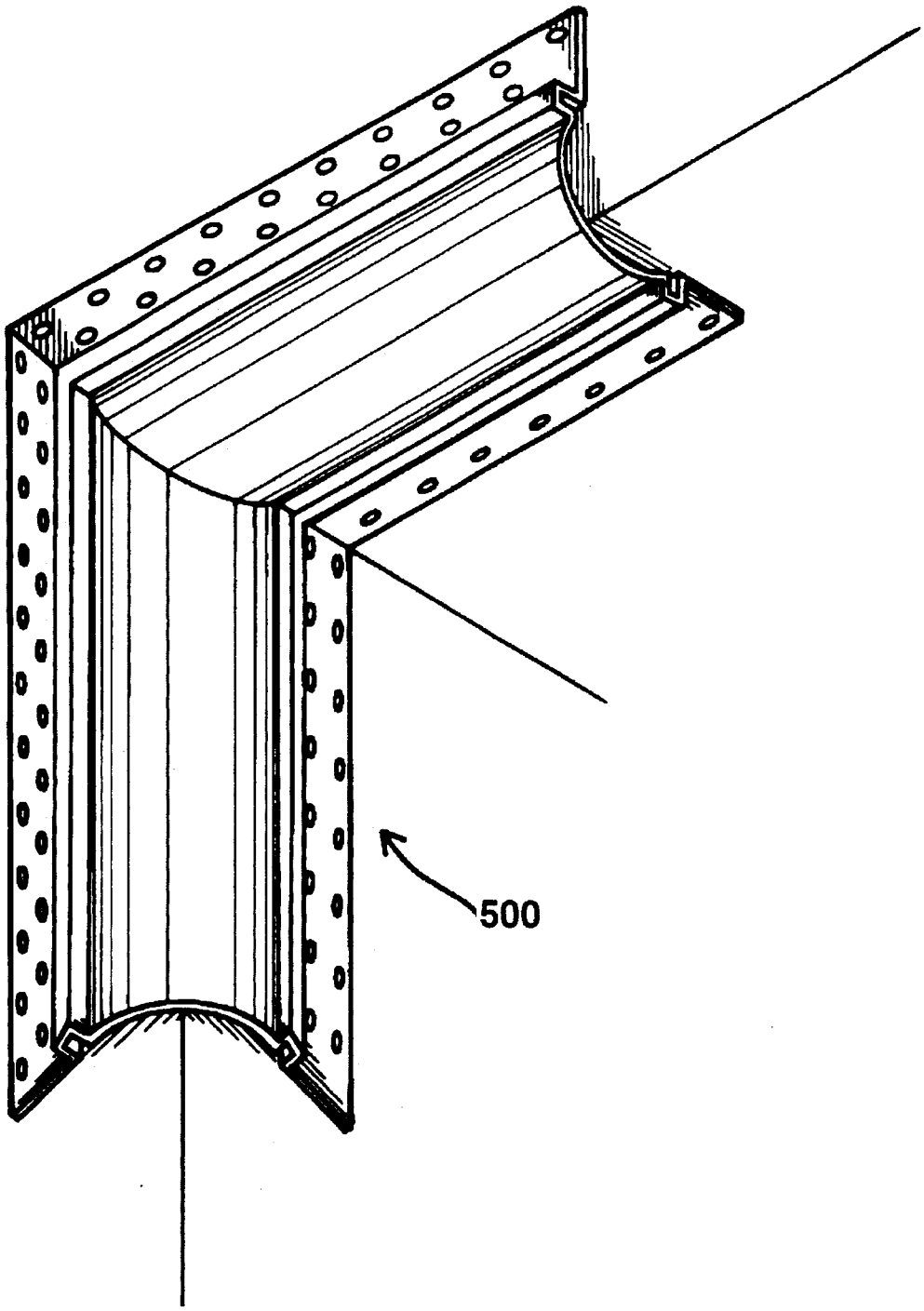
FIG. 12 is an isometric view of a simple intersection fitting typical of an inside opening such as a window or door jamb.

FIG. 12 shows an intersection fitting 500 which is configured for use on an inside corner of an interior opening typically found on door or window casings.

In use, prefinished corner bead is applied after the structural wall surface, i.e., drywall or lath, has been completed. First, the intersection fittings are applied to the intersecting corners as required. Next, the prefinished corner bead is fastened to the structural wall surface to the inside and outside corners as required, and to the intersection fittings already in place. Next, finishing compound, plaster or wood finish is applied over the flanges 1 to abut against stop bead/expansion joint 2 to provide a finished appearance. Finally, plastic film 7 is removed to expose veneer 6 and the top face of stop bead/expansion joint 2.

It may be seen from the illustrations set forth herein that the invention lends itself to many possible embodiments through the combination of features and applications. The illustrations set forth herein are not to be interpreted as limitations upon the claims.

While there is shown and described the present preferred embodiment of the invention, it is to be distinctly understood that this invention is not limited to the description or to the illustrations, but may be variously embodied to practice within the scope of the following claims.

I claim:

1. A prefinished corner molding having a longitudinal axis and two ends, comprising:

a pair of fastening flanges, each flange having a front side, a back side, an inside edge and an outside edge, each flange extending perpendicularly from the longitudinal axis of the corner molding, the pair of flanges having a diverging cross-section;

a pair of stop-bead/expansion joints, each stop-bead/expansion joint having a generally U-shaped cross-sectional configuration, each stop-bead/expansion joint having a pair of walls, each wall having two edges, one edge of each wall converging to form the U-shaped cross-section, the second edge of one wall being joined to a first fastening flange and the second edge of the second wall being joined to a recessed face;

the recessed face, having a front side, a back side, and a pair of edges, the recessed face being disposed between the pair of stop-bead/expansion joints so that one edge of the recessed face is joined to the second edge of one wall of the stop-bead/expansion joint, and the second edge of the recessed face means is joined to the second edge of the second wall of the stop-bead/expansion joint; and a veneer strip configured to fit into the recessed face means.

2. The prefinished corner molding of claim 1 which is further configured to provide a plurality of stop-bead expansion joints.

3. The prefinished corner molding of claim 1 which is further configured for application to an outside corner angle having an included angle between 180° to 360° formed by the juncture of two interior walls.

4. The prefinished corner molding of claim 1 which is further configured for application to an inside corner angle having an included angle between 0° to 180° formed by the juncture of two interior walls.

5. The prefinished corner molding of claim 1 which is further configured for application to an inside corner angle having an included angle between 0° to 180° formed by the juncture of an interior wall and an interior ceiling.

6. The prefinished corner molding of claim 2 which is further configured for application to an outside corner angle having an included angle between 180° to 360° formed by the juncture of two interior walls.

7. The prefinished corner molding of claim 2 which is further configured for application to an inside corner angle having an included angle between 0° to 180° formed by the juncture of two interior walls.

8. The prefinished corner molding of claim 2 which is further configured for application to an inside corner angle having an included angle between 0° to 180° formed by the juncture of an interior wall and an interior ceiling.

9. The prefinished corner molding of claim 1 wherein the veneer strip is covered by a thin removable plastic film.

10. The prefinished corner molding of claim 1 wherein the veneer strip and the stop-bead/expansion joints are covered by a thin removable plastic film.

11. The prefinished corner molding of claim 1 wherein the veneer strip comprises a thin wood strip.

12. The prefinished corner molding of claim 1 wherein the veneer strip comprises a thin metallic strip.

13. The prefinished corner molding of claim 1 wherein the veneer strip comprises a thin plastic strip.

* * * * *